United States Patent [19]

Bauer

[11] 4,300,617

[45] Nov. 17, 1981

[54] PATTERN ASSEMBLIES

[75] Inventor: Timothy R. Bauer, Euclid, Ohio

[73] Assignee: Precision Metalsmiths, Inc., Cleveland, Ohio

[21] Appl. No.: 66,915

[22] Filed: Aug. 16, 1979

[51] Int. Cl.[3] ..... B22C 7/02

[52] U.S. Cl. ..... 164/244; 164/361; 164/363

[58] Field of Search ..... 164/361, 363, 244, DIG. 4, 164/DIG. 15

[56] References Cited

U.S. PATENT DOCUMENTS

| | | | |
|---|---|---|---|
| 1,240,722 | 9/1917 | Huston | 164/363 X |
| 2,291,788 | 8/1942 | Bean | 249/110 |
| 2,919,479 | 1/1960 | Menningen | 164/361 |
| 3,099,052 | 7/1963 | Suzuki et al. | 164/361 X |
| 3,835,913 | 9/1974 | Vandemark et al. | 164/244 X |
| 4,109,699 | 8/1978 | Miller et al. | 164/244 |

*Primary Examiner*—R. L. Spruill
*Assistant Examiner*—J. Reed Batten, Jr.
*Attorney, Agent, or Firm*—Watts, Hoffmann, Fisher and Heinke Co.

[57] ABSTRACT

In the art of investment casting, a refractory mold characterized by a casting system including a sprue passage, a cup at one end of the sprue passage, a runner extending from the cup and connecting to the sprue passage near its other end, at least one pattern cavity gated into the sprue passage between the ends of the runner, and a refractory wall in the cup dividing it into a pouring cup portion communicating with the runner and another portion communicating with the sprue passage. A pattern set-up designed to make the mold by the "lost pattern" process of investment casting.

2 Claims, 6 Drawing Figures

PATTERN ASSEMBLIES

BACKGROUND OF THE INVENTION

The present invention relates generally to the investment casting art, and more specifically to one-piece refractory molds made by the lost pattern process of investment casting.

The lost pattern process of investment casting is typically carried out using a pattern assembly comprised of a group of casting patterns made of wax or similar material so that they can be melted out of the mold. The patterns are attached to a sprue member or center tree to form a casting system known as a "set-up". A pouring cup member is frequently attached to one end of the sprue member.

The set-up is coated or invested with refractory material to form a ceramic shell mold or a bulk investment mold. The set-up is then removed from the mold by a procedure which typically involves melting out the patterns, as in a furnace or an autoclave, to form the pattern cavities. The resulting mold is characterized by a casting system comprising a sprue passage, a pouring cup at one end of the sprue passage, and casting cavities gated into the passage. During casting the molten metal is introduced directly into the sprue passage from the pouring cup. As the metal rises in the sprue passage, it gradually fills the connected pattern cavities.

SUMMARY OF THE INVENTION

The key feature of the present invention is the provision of a new casting system which minimizes air entrapment, metal oxidation, and premature splashing of molten metal into the pattern cavities during pouring. In many applications, the new casting system makes it possible to produce higher quality castings than could be made in the typical investment molds of the prior art.

The new refractory mold comprising one aspect of the invention includes a cup, a sprue passage, a runner having one end which is separated from the sprue passage and opens into the cup and another end which opens into the sprue passage and at least one pattern cavity gated into the sprue passage at a location between the ends of the runner. In the preferred embodiment, the sprue passage and the runner open into the cup and the openings are separated by a refractory wall.

Another aspect of the invention is the provision of a pattern set-up comprising a sprue member, cup means, a runner member having one end connected to the cup means and another end connected to the sprue member, and at least one pattern attached to the sprue member between the cup means and the end of the runner member that is attached to the sprue member. In a preferred construction, the cup means carries a refractory plate that subsequently forms a part of the mold.

During casting with the new mold, molten metal is poured into the portion of the cup connected to the runner. The rate of outflow is controlled by the diameter of the runner. The metal flows down the runner into the bottom portion of the sprue passage where the metal rises in a controlled, non-turbulent manner to fill the sprue passage and then the pattern cavities in an orderly fashion. As the metal rises in the sprue passage, it eventually fills the other section of the cup where it serves as a riser to feed the solidification shrinkage of the metal in the pattern cavities and the sprue passage.

As indicated above, the manner in which the new mold is filled with metal minimizes air entrapment, oxidation, and premature splashing into the pattern cavities. It is also believed that the new casting system places less stress on the mold walls so as to minimize cracking of the refractory material.

Other advantages and a fuller understanding of the invention will be had from the following detailed description taken in conjunction with the accompanying drawings.

DESCRIPTION OF PREFERRED EMBODIMENTS

Figure 1:
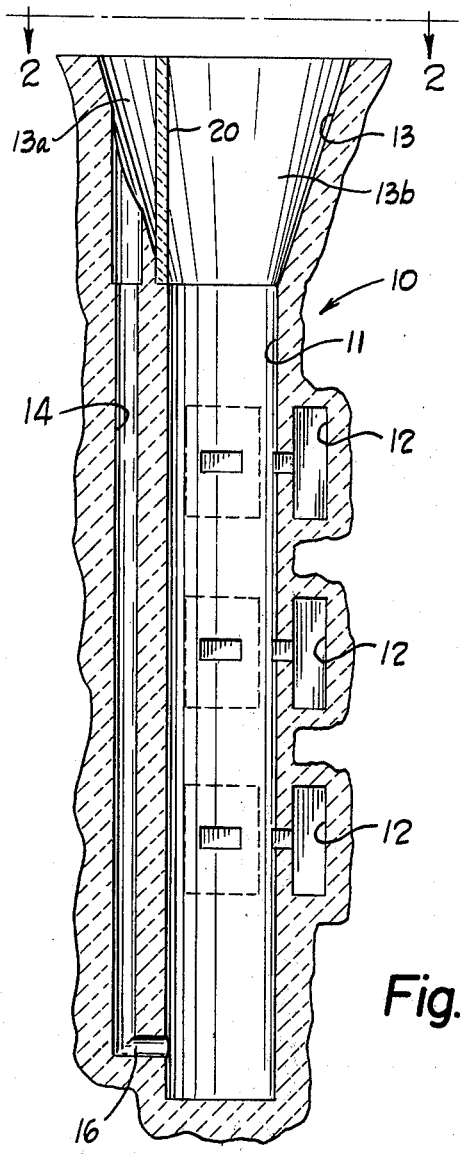
FIG. 1 is a vertical cross-sectional view taken generally on the liine 1—1 of FIG. 2 showing a ceramic shell mold embodying the new casting system of the invention.
Figure 2:
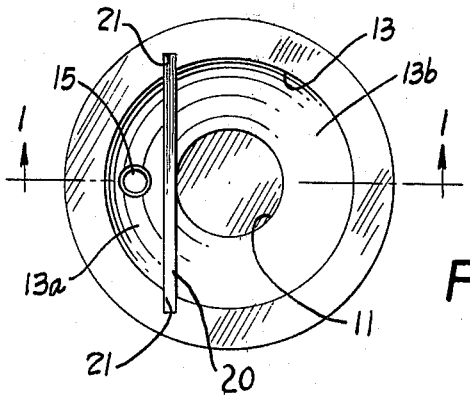
FIG. 2 is a top plan view of the mold taken on the line 2—2 of FIG. 1.

Referring now to the drawings, and to FIGS. 1 and 2 in particular, reference numeral 10 generally designates a one-piece, ceramic shell mold constructed in accordance with a preferred embodiment of the present invention. The mold 10 comprises a sprue passage 11, a plurality of pattern cavities 12 gated into the sprue passage 11 and a frusto-conical cup 13 at one end of the sprue passage.

In accordance with the invention, a down runner 14 extends alongside the sprue passage 11. The runner 14 has an opening 15 into the cup 13 and a lower opening 16 into the sprue passage 11. The openings of the pattern cavities 12 into the sprue passage 11 are located between the runner openings 15, 16.

A refractory plate 20 extends across the cup 13 to divide it into two sections **13*a*, 13*b* and separate the sprue passage 11 from the runner opening 15. The runner opening 15 communicates with the cup section 13*a* and the sprue passage 11 communicates with the cup section 13*b*. As shown most clearly in FIG. 2, the side edges of the plate 20 are inserted into slots 21 formed in the wall of the cup 13. If desired, the plate 20** can be sealed in position with ceramic slurry, although this is not usually necessary.

The casting operation is carried out by pouring molten metal into the cup section **13*a*. The rate of outflow of molten metal is controlled by the diameter of the runner 14 and the runner opening 15. The molten metal flows down the runner 14 through the opening 16 into the sprue passage 11. The metal rises in the sprue passage 11 in a controlled, non-turbulent manner to fill the sprue passage and the pattern cavities 12. Pouring is continued until the molten metal rises into and fills section 13*b* of the cup. The head of metal in the cup section 13*b* serves as a riser to feed the solidification shrinkage of the metal in the sprue passage 11 and the pattern cavities 12. The controlled introduction of metal into the bottom of the sprue passage 11 reduces air entrapment in the pattern cavities 12**. It also minimizes oxidation of the molten metal and premature splashing into the pattern cavities. As a result, higher quality castings are produced in many applications than could be made in the investment molds of the prior art.

Figure 3:
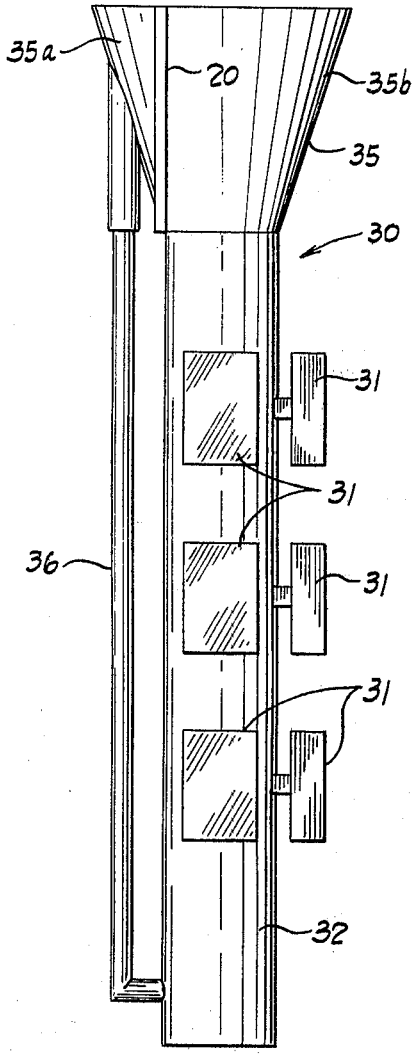
FIG. 3 is an elevational view of a pattern set-up used to make the mold of FIGS. 1 and 2.
Figure 4:
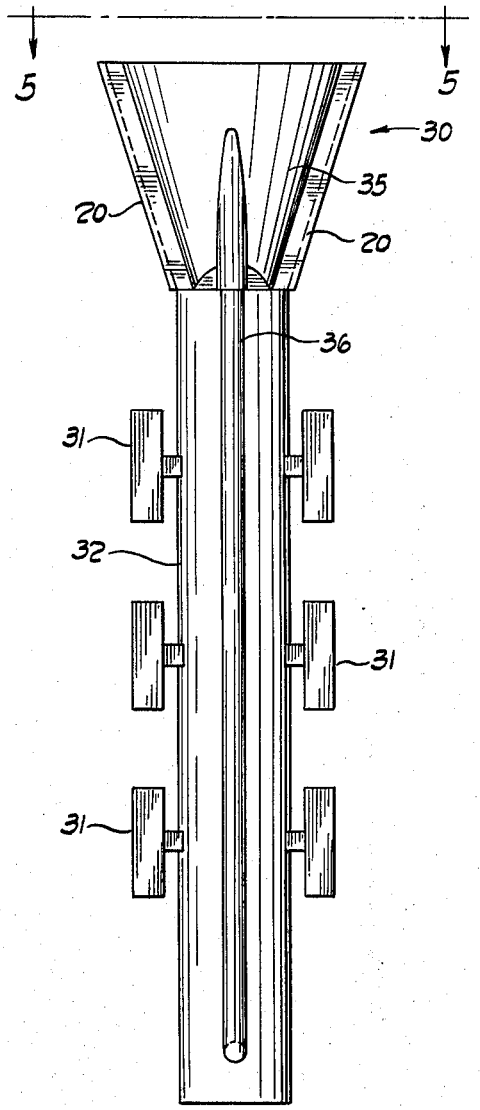
FIG. 4 is another vertical elevational view of the set-up illustrated in FIG. 3.
Figure 5:
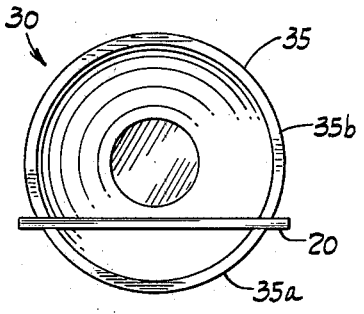
FIG. 5 is a top plan view taken on the line 5—5 of FIG. 4.

Reference is now made to FIGS. 3–5 which illustrate a pattern set-up 30 used to make the mold 10. The set-up 30 comprises a plurality of casting patterns 31 which are connected to the outside wall of a sprue member 32. The casting patterns 32, which are replicas of the parts to be cast in metal and include the necessary gates and risers, are formed of an expendable material such as wax, a synthetic resin, or more preferably a wax and resin composition.

The sprue member 32 may be made in accordance with any conventional practice. According to one such practice, the construction may comprise a cardboard tube surrounded by a paper sleeve provided with a thin surface coating of wax or the like. Alternatively, the sprue member 32 may consist simply of a tube made of an expendable pattern material such as wax. Other suitable constructions are described in U.S. Pat. No. 3,520,350 dated July 14, 1970.

The set-up 30 includes a frusto-conical cup pattern 35 made of wax or the like at one end of the sprue member 32. The preferred cup pattern 35 is hollow and is closed at its larger, open end by a plate (not shown) when the set-up 30 is coated or invested with refractory material. In the embodiment of the invention illustrated in FIGS. 3–5, the cup pattern 35 directly incorporates the refractory plate 20 that divides the cup of the mold 10 into two sections. According to this embodiment of the invention, the cup pattern 35 is formed in two sections 35*a* and 35*b*. The two cup sections 35*a*, 35*b* are cemented to opposite faces of the refractory plate 20 so that the side edges of the plate project beyond the periphery of the cup, as shown in FIGS. 4 and 5. When the mold 10 is formed around the cup pattern 35 and the pattern is subsequently melted out of the mold, the plate 20 will remain in the mold as illustrated in FIGS. 1 and 2.

A runner member 36 extends alongside the sprue member 32 and has one end portion attached to the outside wall of section 35*a* of the cup pattern 35. The other end of the runner member 36 is attached to the sprue member 32 at a location such that the casting patterns 31 are located between the ends of the runner member. As discussed above, the diameter of the runner member 36 is selected to produce a controlled outflow of molten metal from the cup into the runner cavity in the mold. In the illustrated embodiment, the top of the sprue member 32 is attached to the bottom of the cup portion 35*b*.

Figure 6:
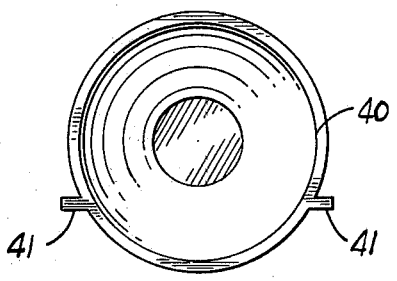
FIG. 6 is a top plan view of a modified embodiment of the new pattern set-up of the invention

FIG. 6 illustrates a modified embodiment that includes a cup 40 formed with two exterior bosses 41 which correspond to the projecting edges of the plate 20 in the embodiment of FIGS. 3–5. The bosses 41 serve to form the plate-receiving slots 21 in the mold 10.

The set-up 30 is used to make the ceramic shell mold 10 in the usual manner. As is known to those familiar with the art of investment casting, the formation of a shell mold around a set-up is accomplished by dipping it into a refractory slurry of controlled viscosity followed by directional draining to coat the casting patterns uniformly. After draining excess slurry from the set-up, the slurry coating is sanded or stuccoed while wet with coarser refractory particles, such as by dipping the set-up into an air-fluidized bed of dry refractory material. The result is a coat of ceramic material having refractory particles embedded in the surface. This coat is hardened, usually by air drying at room conditions. After the first coat is sufficiently hard and dry, the steps of dipping, draining, stuccoing and drying are repeated until a refractory shell having a sufficient thickness to resist the stresses occurring in subsequent operations has been built up around the set-up. The usual shell thickness is from $\frac{1}{8}$ inch to about $\frac{1}{2}$ inch; although thicker or thinner shells may be formed for special situations. The set-up including the disposable patterns is then removed from the shell mold and the mold is prepared for the casting operation. Those familiar with the art of investment casting will also recognize that the new set-up 30 can be used to advantage in making bulk investment molds by a procedure which involves placing the set-up in a flask and investing it with a suitable refractory slurry which is allowed to harden to form a thick walled mold.

Many modifications and variations of the invention will be apparent to those skilled in the art in light of the foregoing detailed disclosure. Therefore, it is to be understood that, within the scope of the appended claims, the invention can be practiced otherwise than as specifically shown and described

What is claimed is:

1. A set-up for making refractory molds by the lost pattern process comprising a sprue member, cup means attached to one end of said sprue member, a runner member having one end attached to said cup means and another end attached to said sprue member, bosses on the outside of said cup means designed to form plate-receiving slots in a mold wall formed around said cup means, and pattern means connected to said sprue member between said cup means and said another end of said runner member.

2. A set-up for making refractory molds by the lost pattern process comprising a sprue member, cup means attached to one end of said sprue member, a runner member having one end attached to said cup means and another end attached to said sprue member, a refractory plate carried by said cup means between said one end of said sprue member and said one end of said runner member, and pattern means connected to said sprue member between said one end of said sprue member and said another end of said runner member.

* * * * *